US005516326A

United States Patent [19]

Virnich

[11] Patent Number: 5,516,326

[45] Date of Patent: May 14, 1996

[54] ABRASIVE WHEEL

[75] Inventor: Karl H. Virnich, Attendorn, Germany

[73] Assignee: August Rüggeberg, Marienheide, Germany

[21] Appl. No.: 936,443

[22] Filed: Aug. 28, 1992

[30] Foreign Application Priority Data

Sep. 2, 1991 [DE] Germany ..... 41 29 090.9

[51] Int. Cl.[6] ..... B24B 41/00

[52] U.S. Cl. ..... 451/340; 451/342; 451/548

[58] Field of Search ..... 51/166, 168, 209; 451/340, 342, 548, 550, 343

[56] References Cited

U.S. PATENT DOCUMENTS

| | | | |
|---|---|---|---|
| 726,378 | 4/1903 | Tucker | 51/168 |
| 1,753,377 | 4/1930 | Jackson et al. . | |
| 1,775,004 | 9/1930 | Steiner | 51/168 |
| 2,069,788 | 2/1937 | Van Der Pyl et al. | 51/209 |
| 2,616,229 | 11/1952 | Allison | 51/168 |
| 2,616,230 | 11/1952 | Hough | 51/168 |
| 2,894,583 | 7/1959 | Johnstad . | |
| 3,386,211 | 6/1968 | Wagner | 51/168 |
| 3,753,430 | 8/1973 | Oas . | |
| 3,967,415 | 7/1976 | Seckinger et al. | 51/168 |
| 4,251,955 | 2/1981 | Shawke | 51/168 |
| 4,393,626 | 7/1983 | Schroer | 51/168 |

FOREIGN PATENT DOCUMENTS

| | | | |
|---|---|---|---|
| 0543437 | 6/1956 | Belgium | 51/209 |
| 2156770 | 5/1973 | Germany . | |
| 2826374 | 1/1980 | Germany . | |
| 2924859 | 2/1980 | Germany . | |
| 3322258 | 6/1984 | Germany . | |
| 3635973 | 5/1988 | Germany . | |
| 3823591 | 7/1989 | Germany . | |
| A417229 | 10/1934 | United Kingdom . | |

*Primary Examiner*—Bruce M. Kisliuk
*Assistant Examiner*—Eileen P. Morgan
*Attorney, Agent, or Firm*—Browdy and Neimark

[57] ABSTRACT

An abrasive wheel has a central support and an abrasive ring releasably and exchangeably fastened thereto and which on the one hand bears against an annular flange connected with the support and is braced against this by means of a locking ring and a locking flange.

4 Claims, 5 Drawing Sheets

ABRASIVE WHEEL

FIELD OF THE INVENTION

The invention relates to an abrasive wheel, in particular an abrasive roughing wheel or abrasive cutting-off wheel, with a support formed to be concentrical of an axis of symmetry and having a hub, and with an abrasive tool arranged on the support.

BACKGROUND OF THE INVENTION

Abrasive wheels of the generic kind, which may be in the form of abrasive roughing wheels or of abrasive cutting-off wheels, have an abrasive tool tightly fastened on the internal support provided with a hub. The wear of abrasive roughing wheels is in the range of not more than 50 to 70% of the original diameter, i.e. a considerable part of the abrasive tool does not wear out. This unworn portion is in the range of 30 to 50% of the original weight of the abrasive wheel. In like manner, a considerable part of the abrasive tool is not used up with abrasive cutting-off wheels. This remaining waste must be disposed of in special refuse dumps increasingly giving rise to problems, since the number of special refuse dumps is declining and the costs hereby incurred are increasing extremely.

It is known from DE 38 23 591 A1 to provide a disk-shaped body coated with an abrasive with a two-piece flange, which centrally accommodates the disk-shaped abrasive body on the one hand and which, on the other hand, is mountable.

SUMMARY OF THE INVENTION

It is an object of the invention to embody an abrasive wheel of the generic kind, in which the quantity of waste to be disposed of is strictly reduced.

In accordance with the invention this object is attained in that the abrasive tool is formed as an abrasive ring independent of the support, and in that, in the vicinity of its outer circumference, the support is provided with an accommodation adjusting the abrasive ring central with the axis of symmetry, and with a releasable locking device for mounting the abrasive ring on the support. The center of the abrasive wheel consists of a re-usable support made of metal as a rule. It may essentially have the contour of the center of conventional abrasive wheels. The abrasive tool is structured as an independent, exchangeable abrasive ring. When most of the abrasive ring has been used up, its remainders are removed from the support after disengagement of the locking devices, and a new abrasive ring is inserted and again secured by means of the locking devices. Only this remaining waste must be disposed of.

When, in the area of one side, the support has, as part of the locking device, an annular flange projecting from its outer circumference and against which bears the abrasive ring and when a locking ring is connectable with the support and has a locking flange bearing against the abrasive ring, this reflects the advantageous basic concepts for structuring the locking device, by which the abrasive ring is firmly arrested on the support in the direction of the axis of the abrasive wheel on the one hand and in the tangential direction thereto on the other hand, so that the torque transmission from the support to the abrasive ring is primarily taking place by force locking.

An especially preferred embodiment of a locking ring is reflected by the locking ring being provided with an annular nut screwable into the support, by the accommodation being formed as a cylindrical receiving face on the locking ring and by openings being provided on the locking ring for rotating tools to engage with. When the locking ring is provided with an annular nut screwable into the support, this simultaneously indicates the structure of the accommodation which adjusts the abrasive ring central with the support.

In keeping with a further object of the invention it is provided that the locking ring is releasably fastened on the support by means of screws, or by means of locking bolts.

Further advantages, features and details of the invention will become apparent from tile further sub-claims and the ensuing description of several examples of embodiment of the invention taken in conjunction with the drawing.

DESCRIPTION OF THE PREFERRED EMBODIMENTS

Figure 1:
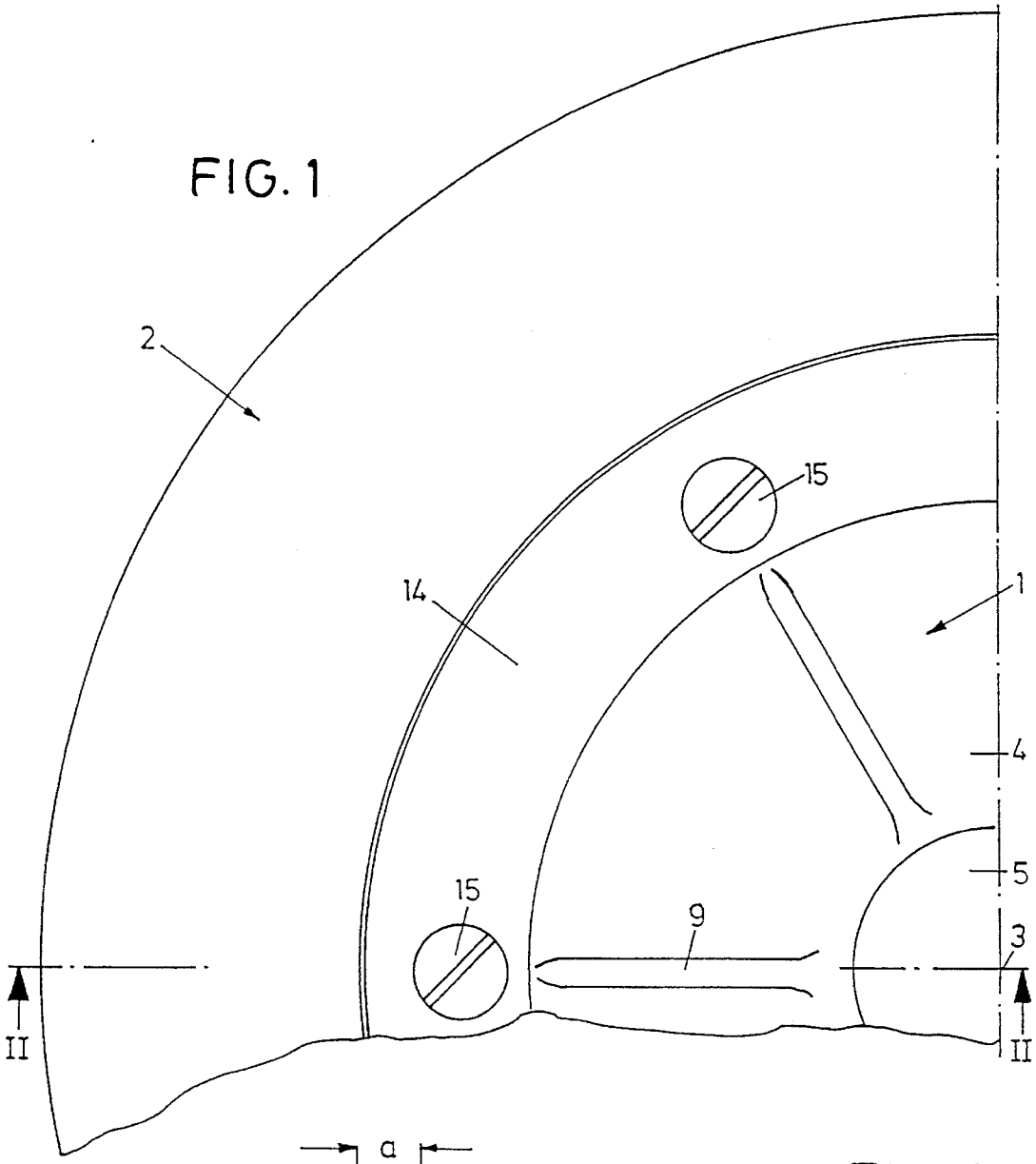
FIG. 1 is a partial representation of an abrasive roughing wheel in a plan view.
Figure 2:
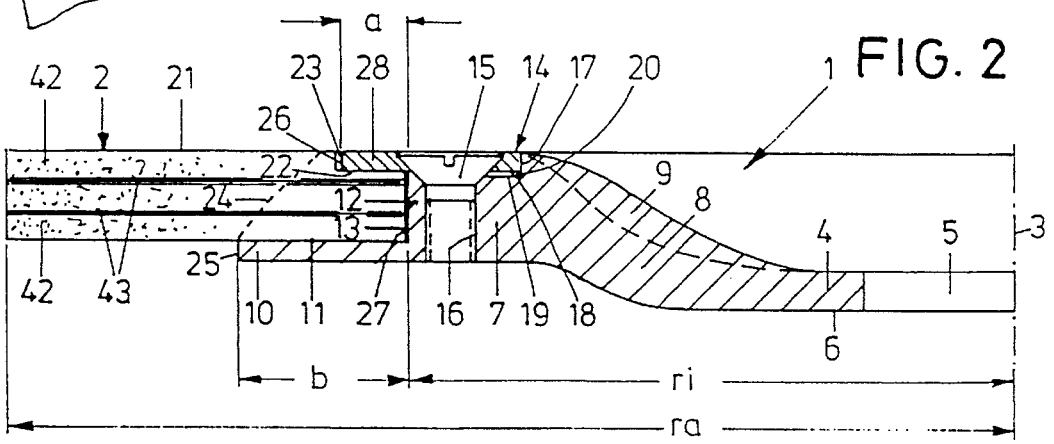
FIG. 2 is a partial cross-section through the abrasive roughing wheel according to the section line II—II in FIG. 1.

The example of embodiment according to FIGS. 1 and 2 refers to an abrasive roughing wheel with a central support 1 of metal and an abrasive roughing ring 2. It has a central axis of symmetry 3. Concentrically of the axis 3, the support 1 has a hub 4 with an opening 5, which serve to fasten the abrasive wheel in usual manner on a drive shaft of a grinding machine. Shown at the bottom of each drawing, the rear 6 of the hub 4 of the support 1 is bent at right angles referred to the abrasive ring 2 and arranged adjacent to the machine. In its external portion the support 1 has a receiving section 7 for an abrasive ring 2. A cranked transition area 8 between the hub 4 and the receiving section 7 is provided with stiffening ribs 9 extending radially referred to the axis 3.

In the vicinity of the rear 6 the receiving section 7 of the support 1 has an annular flange 10 as an abutment for the rear 11 of the abrasive ring 2. Concentrically of the axis 3 and subsequent to the annular flange 10, the receiving section 7 further has a cylindrical receiving face 12 serving as an accommodation and onto which the abrasive ring 2 is placed, so that its inner circumferential surface 13 encircles the receiving face 12 concentrically and virtually free of play. The abrasive ring 2 is thus centered on the cylindrical receiving face 12 in relation to the support 1 and the latter's axis 3, respectively. On the side opposite to the rear 6, a locking ring 14 structured as a flat annular disk is fastened by means of countersunk screws 15, which are screwed into threaded bores 16 located in the receiving section 7 and extending parallel to the axis 3. For its alignment with the front of the support 1, the locking ring 14 is arranged in a corresponding annular recess 18 on the front 17 of the receiving section 7. The locking ring 14 has some play 20 in relation to the bottom 19 of the recess 18. For the purpose of a locking flange 28 of the locking ring 14 also being substantially in alignment with the front 21 of the abrasive ring 2, an annular recess 22 accommodating the locking flange 28 is formed in the front 21 adjacent to the inner circumferential surface 13, the recess 22 having little radial play related to the locking ring 14. Thus the abrasive roughing ring 2, with its inner circumferential surface 13, is centered on the receiving face 12 of the receiving section 7 of the support 1 and is releasably engaged between the locking flange 28 and the annular flange 10. The abrasive roughing ring 2 can be ground off about as far as the remaining circumferential surface 24 of the abrasive ring 2 shown in a dashed line and which connects the outer circumference 25 of the annular flange 10 and the outer circumference 26 of the locking ring 14.

As regards the geometric relations of the specified abrasive wheel the following applies:

The interior radius of the abrasive ring 2 is designated as ri, its exterior radius being ra. The radial extension of the locking flange 28 over the abrasive ring 2, i.e. the width of engagement of the locking flange referred to the abrasive ring 2 is designated as a, whereas the radial extension of the annular flange 10 in relation to the abrasive ring 2 is designated as b. In this regard the following relations apply:

$$0.01\ (ra-ri) \leqq a \leqq 0.10\ (ra-ri)$$

$$0.05\ (ra-ri) \leqq b \leqq 0.25\ (ra-ri)$$

$$0.35 \leqq ri/ra \leqq 0.65$$

Figure 3:
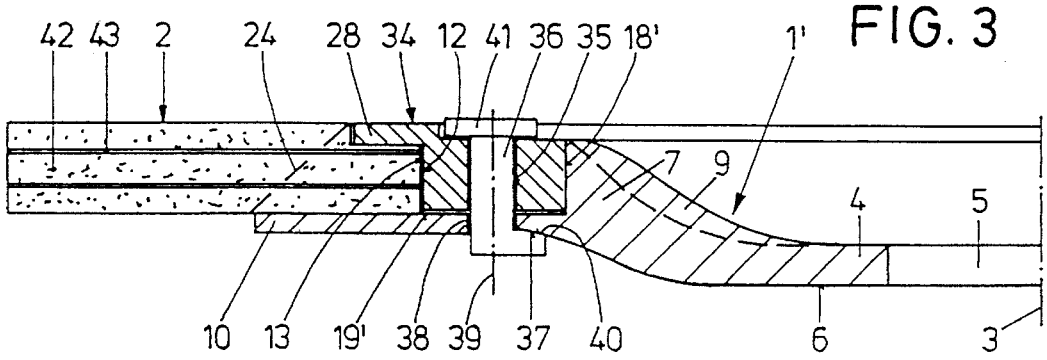
FIG. 3 is a partial cross-section of a further embodiment of an abrasive roughing wheel.

The radial play 27 between the receiving face 12 and the inner circumferential surface 13 of the abrasive ring 2 amounts to as much as 0.2 mm.

Where identical components exist in the embodiment according to FIG. 3 and in the embodiment according to FIGS. 1 and 2, the same reference numerals are used. If there are components of identical function with only minor constructional differences, they are identified by the same reference numerals provided with a prime, without a renewed description being necessary. In this embodiment the essentially annular cylindrical locking ring 34, which is formed in one piece with the locking flange 28, is made thicker in the direction of the axis 3 than the disk-shaped locking ring 14. It is arranged radially free of play in a recess 18'. It has bores 35 extending in parallel to the axis 3 and in each of which a locking bolt 36 is arranged. At its end facing the rear 6 each locking bolt 36 has an about hook-shaped and inclined locking face 37, which is piloted through a keyhole-type hole 38 in the bottom 19' of the recess 18'. When the locking bolt 36 is rotated about its longitudinal axis 39, its locking face 37 engages with a corresponding and likewise inclined opposing face 40 on the rear of the support 1', whereby the locking ring 34 is braced against the abrasive ring 2 in the direction of the axis 3 and in the direction towards the rear 6 of the support 1'. Thus, these locking bolts 36 may be locked or unlocked by a rotation of about 90° around their longitudinal axis 39. In this regard the locking or unlocking can be performed in less time than in the embodiment according to FIGS. 1 and 2. The rotation of the locking bolts 36 around their longitudinal axis 39 is made by their head 41, which also bears against the locking ring 34, being correspondingly engaged.

The abrasive roughing rings 2 used in the examplary embodiments according to FIGS. 1 to 3 substantially consist of a synthetic resin as a binding agent, and of fillers and corundum or silicon carbide as the abrasive grain 42. To increase the rupture strength, one or several glass-fiber reinforcement layers 43 may be provided. The part of the abrasive ring 2 located between the remaining circumferential surface 24 and the inner circumferential surface 13 is waste.

Figure 4:
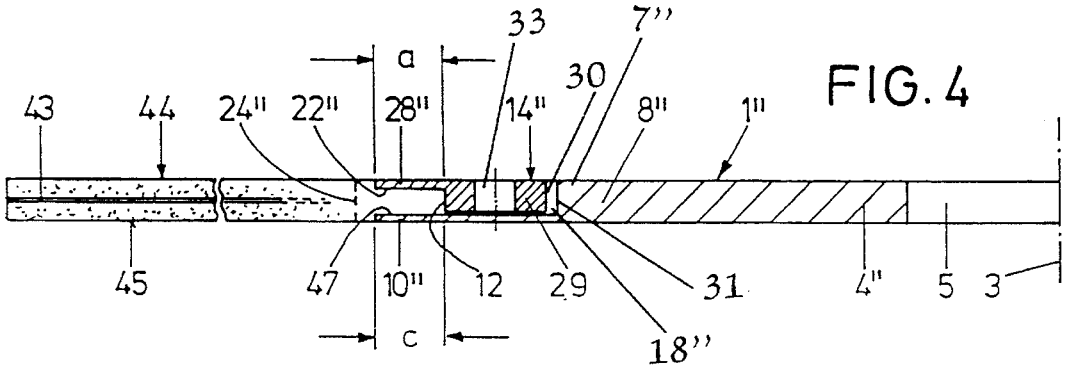
FIG. 4 is a partial cross-section through an embodiment of an abrasive cutting-off wheel.

In the example of embodiment according to FIG. 4, components that are identical with the parts described before again have the same reference numerals, and components of identical function, but differing in construction, have the same reference numerals provided with a double prime. In this example of embodiment abrasive cutting-off rings 44 are used which, as for their external dimensions, only differ from the abrasive rings 2 in thickness in the direction of the axis 3. They have at least one reinforcement layer 43 and abrasive grain 42 and synthetic resin as a binding agent as well as fillers. The locking ring 14" is formed by an essentially annular cylindrical sleeve nut 29, which can be screwed with an internal thread 30 on an external thread 31 of the receiving section 7" of the support 1", this external thread 31 being formed in a recess 18" of the support 1". The locking flange 28" is formed in one piece with the sleeve nut 29. Blind hole bores 33 are arranged, into which suitable tools can be introduced to release or tighten the sleeve nut 29.

In the embodiment according to FIG. 4 an annular recess 47 is also formed on the rear 45 of the abrasive cutting-off ring 44 and an annular flange 10" of correspondingly thin shape engages with it. In like manner, the locking ring 14" is made comparatively thin, so that on the one hand the abrasive cutting-off ring 44 is not weakened too much in the area of its engagement between the annular flange 10" and the locking ring 14", and on the other hand the annular flange 10" and the locking ring 14" are in alignment with the abrasive cutting-off ring 44 and do not project beyond the latter. The transition area 8" of the support 1" to the hub 4" is not cranked, i.e. the entire abrasive cutting-off wheel according to FIG. 4 has the shape of a flat annular-cylinder-disk plane on both sides. With this abrasive cutting-off wheel, the abrasive cutting-off ring 44 can be used up almost as far as into the vicinity of the locking flange 28" and the annular flange 10", i.e. a remaining circumferential surface 24" is located in this area. This is due to the fact that during abrasive cutting also the support 1" not projecting over the abrasive cutting-off ring 44 can immerse into the material to be cut.

In the especially preferred embodiment according to FIG. 5, again, identical reference numerals are used for components corresponding to parts already described; components of identical function, but slightly differing in construction have the same reference numerals provided with a triple prime, without a renewed and detailed description being necessary in each case. Illustrated is part of a grinding machine 50 having a grinding-wheel spindle 51 drivable by a motor. On this grinding-wheel spindle an accommodating flange 52 is conventionally fastened, which has an annular collar 53 centrally accommodating the annular cylindrical support 1'''. On its periphery the support 1''' is provided with an annular flange 10''', against which the abrasive roughing ring 2''' rests centrally. Centering thus takes place between the inner circumferential surface 13 of the abrasive roughing ring 2''' and the cylindrical receiving face 12''' of the annular flange 10'''.

The locking ring 14''' is formed as a substantially closed annular disk provided with an internal thread 54 only in the vicinity of the axis 3 matched by an external thread 55 of the grinding-wheel spindle 51. Moreover, the locking ring 14''' has bores 56 for a locking tool to engage with. The locking ring 14''' is provided with a receiving face 12'''a of the same dimeter as the receiving face 12''' and which thus also centrally bears against the inner circumferential surface 13 of the abrasive ring 2'''. Here, too, the locking flange 28''' is formed in one piece with the locking ring 14'''. It rests—same as in the embodiment according to FIG. 1—in an annular recess 22''' of the abrasive ring 2''' and that such that it does not project over the front 21''' of the abrasive ring 2'''. The abrasive roughing ring 2''' is thus arrested on the grinding-wheel spindle 51 by means of the locking ring 14''' and the support 1'''. In a condition not mounted on the grinding-wheel spindle 51, the support 1''', the abrasive roughing ring 2''' and the locking ring 14''' only form a set of structural components. The radial extension a of the locking flange 28'' equals the radial extension c of the annular flange 10''. The relation given above for a also applies to the extension a and c. This structure has the advantage that it can be mounted on all commercially available grinding machines without any special locking tools.

Figure 5:
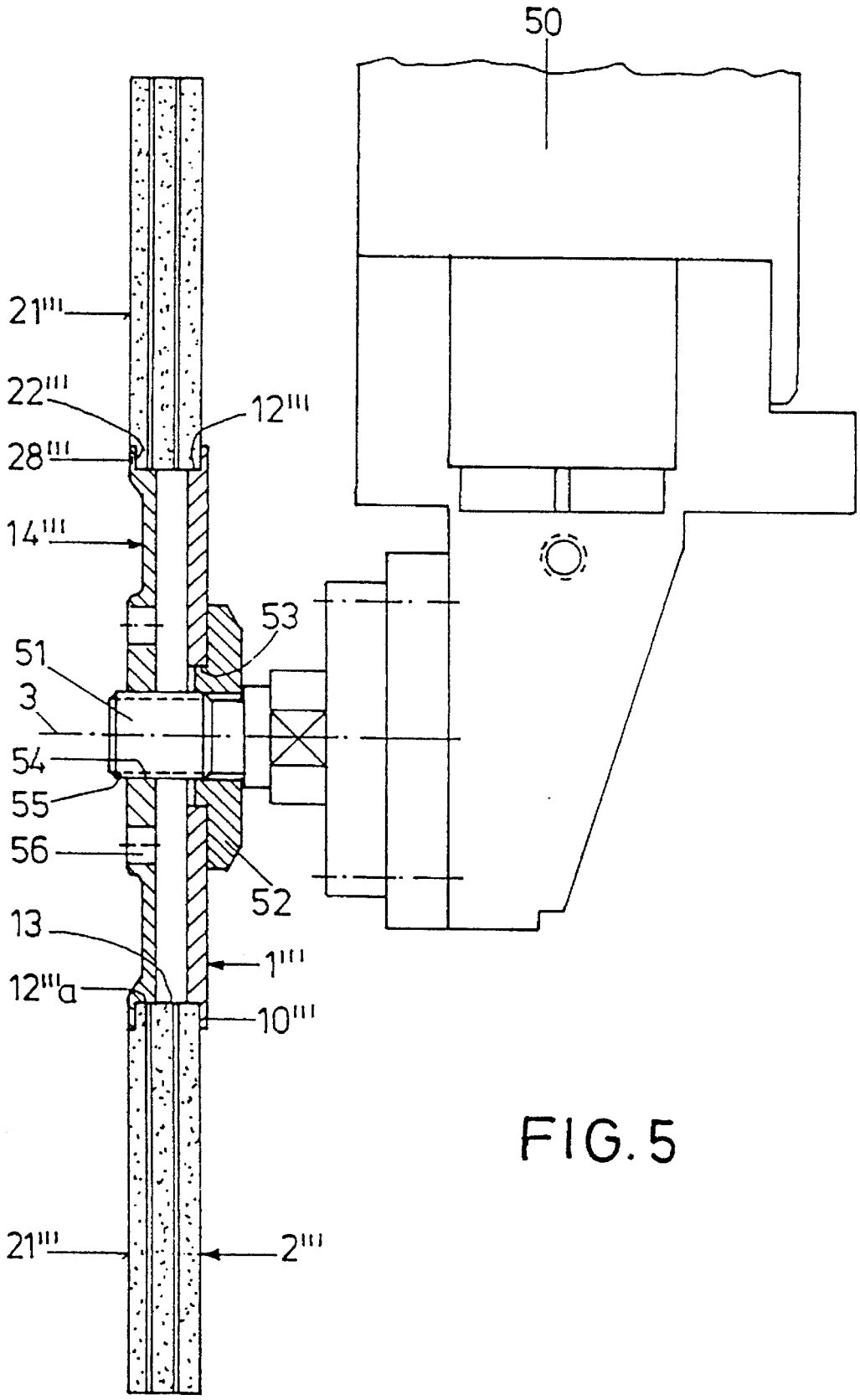
FIG. 5 is a cross-section through an embodiment of an abrasive roughing wheel in a condition when it is locked onto a grinding-wheel spindle of a grinding machine.
Figure 6:
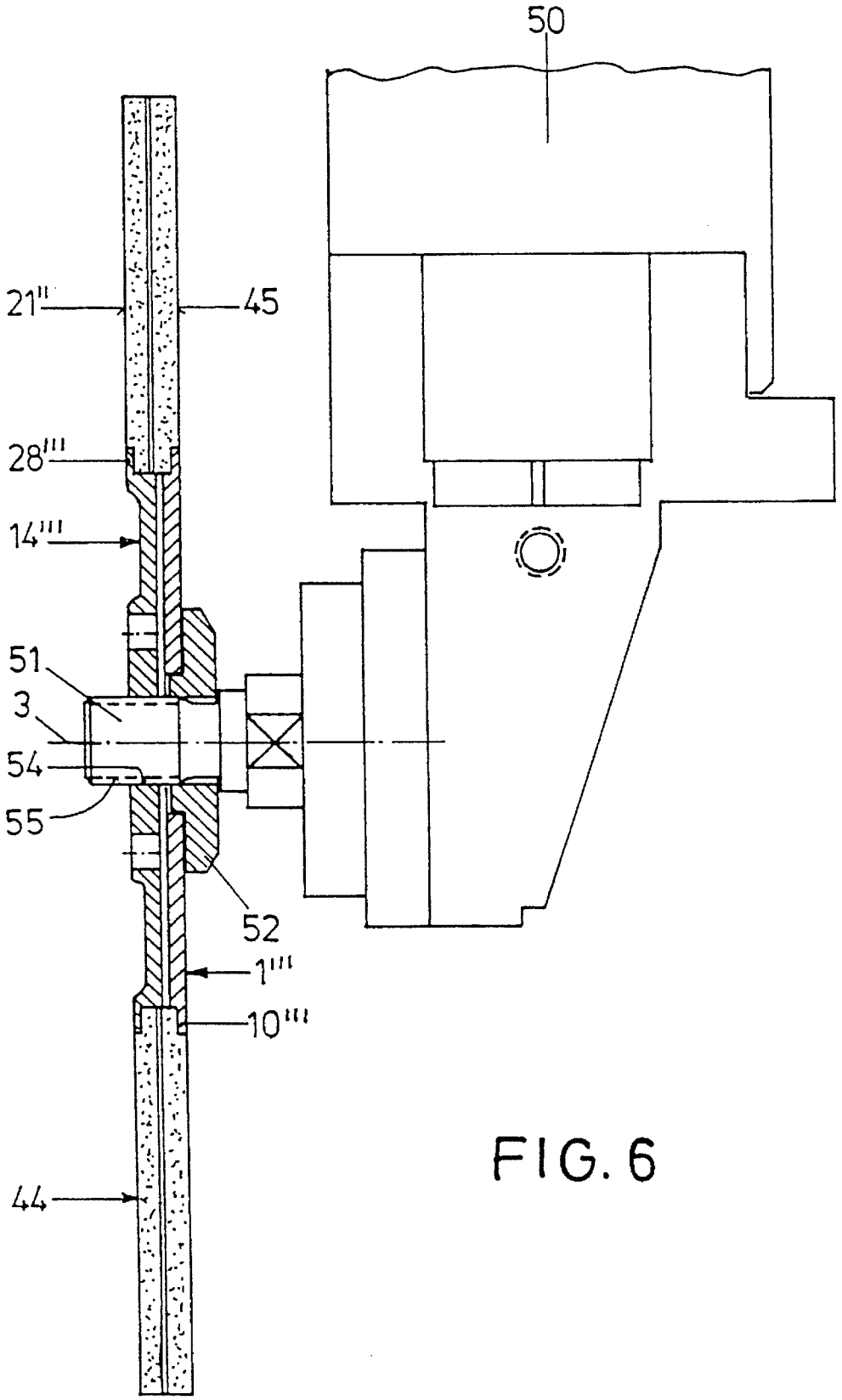
FIG. 6 is a partial cross-section through an abrasive roughing wheel in an embodiment corresponding to FIG. 5.

It is outlined in FIG. 6 that the support 1''' and the locking ring 14''' of the embodiment according to FIG. 5 may also be used without any modification in order to arrest an abrasive cutting-off ring 44 as shown in FIG. 4 on the grinding-wheel spindle 51. In this case neither the annular flange 10''' of the support 1''' nor the locking flange 28''' project over the rear 45 and the front 21'', respectively.

The abrasive cutting-off ring 44 can deeply immerse into a workpiece without the support 1''' and the locking ring 14''' colliding with the workpiece, which may be as far as to the accommodating flange 52. This embodiment is preferred with stationary grinding machines.

Figure 7:
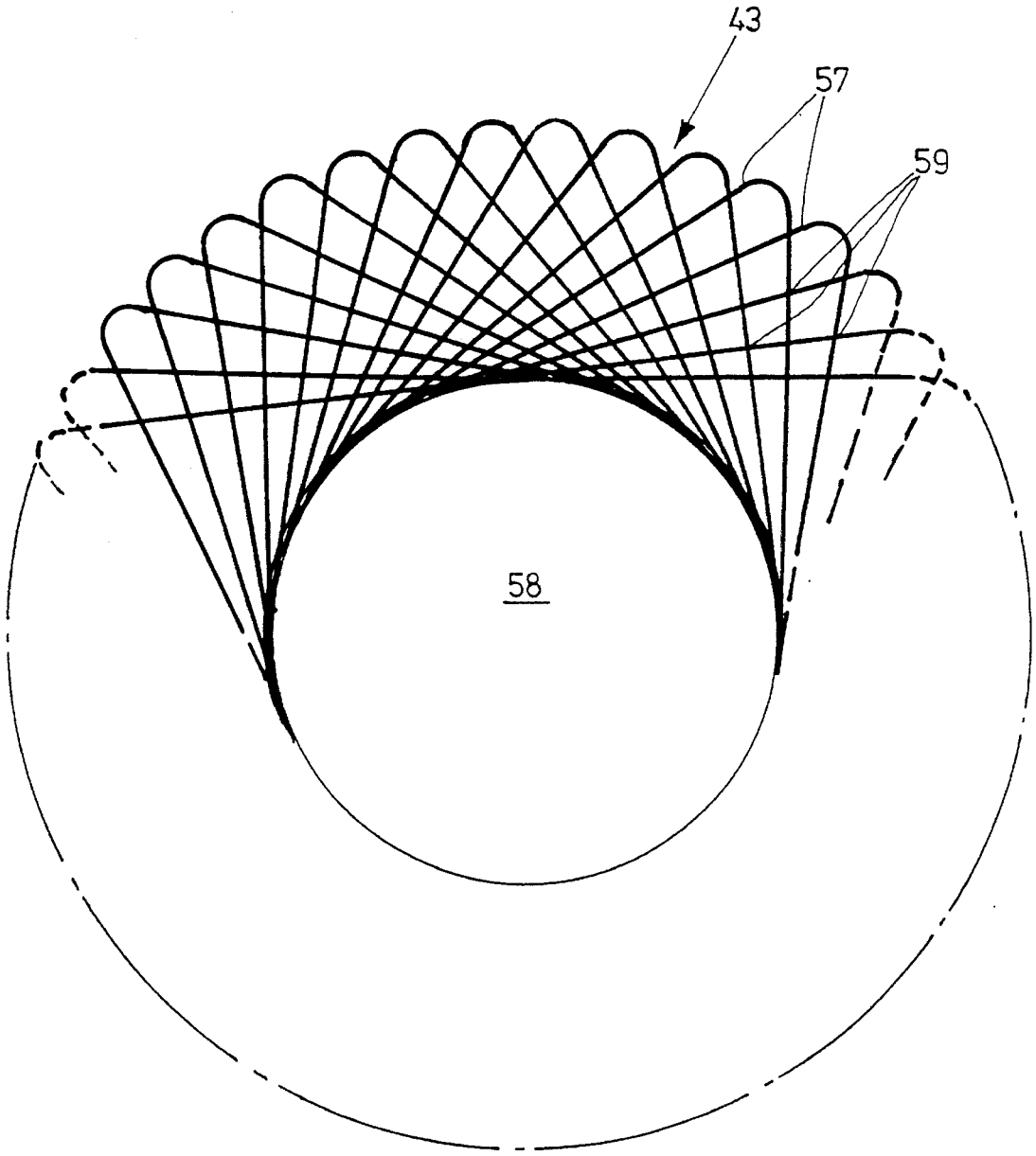
FIG. 7 is a plan view of a reinforcement layer for the abrasive rings.

FIG. 7 shows a reinforcement layer 43 specified in German patent application P 41 32 883.0, which is to be used with such abrasive roughing rings 2, 2''' and abrasive cutting-off rings 44. Such a reinforcement layer 43 consists of one or several reinforcing threads 57, which optimally counteract any tangential and radial strain of the abrasive ring. In the vicinity of a central opening 58 the reinforcing threads 57 extend exactly tangentially; they continue to extend radially tangentially to the outer circumference, where they are deflected and returned in a straight line to the opening 58, which they pass tangentially. Thus, they essentially extend in accordance with the stress actually imposed on the rotating abrasive ring 2, 2''' and 44, respectively. The greatest principal stress of a rotating abrasive ring extends in the tangential direction. In the vicinity of the opening 58, i.e. radially inwards, the stress has its maximum, which continuously decreases outwards. For this reason it is adequate that the reinforcing threads 57 extend exactly tangentially only in the vicinity of the opening 58, but that, between the opening 58 and the periphery, they are given a radial component so as to counteract the radial stress which is also strong in this area. The reinforcing threads 57 are connected with each other by a synthetic resin at each intersection 59. The reinforcing threads are soaked with a synthetic-resin solution prior to being arranged in the pattern shown in FIG. 7.

Once arranged, they are hot-pressed, whereby this synthetic resin starts curing causing a connection of the reinforcing threads 57 at the intersections 59. This reinforcement layer 43 is thus sufficiently inherently stable to be used for the manufacturing of an abrasive ring 2, 2''' and 44, respectively.

Of course, in all the embodiments the abrasive ring is so firmly engaged between the annular flange and the locking ring that the necessary torque transmission can be and is performed from the support to the abrasive ring.

What is claimed is:

1. An abrasive wheel, in particular an abrasive roughing wheel or abrasive cutting-off wheel, comprising a support (1, 1', 1'', 1''') formed to be concentrical of an axis of symmetry (3) and having a hub (4, 4', 4'''), and an abrasive tool arranged on the support (1, 1', 1', 1'''), wherein the abrasive tool arranged is formed as an abrasive ring (2, 2''', 44) independent of the support (1, 1', 1'', 1'''), and wherein, in the vicinity of its outer circumference the support (1, 1', 1'', 1''') is provided with an accommodation (12, 12'', 12''') adjusting the abrasive ring (2, 2''', 44) central with the axis of symmetry (3), and with a releasable locking device for mounting the abrasive ring (2, 2''', 44) on the support (1, 1', 1'', 1'''), wherein in the area of one side (6) the support (1, 1', 1'', 1''') has, as part of the locking device, an annular flange (10, 10'', 10''') projecting from its outer circumference and against which bears the abrasive ring (2, 2''', 44), wherein the annular flange (10'', 10''') is arranged in alignment with the rear (45) of the abrasive ring (2''', 44) in a recess (47) of the abrasive ring (44), wherein a locking ring (14, 14 ', 14'', 14''') is connectable with the support (1, 1', 1'') and has a locking flange (28, 28'', 28''') bearing against the abrasive ring (2, 2''', 44)

wherein the locking ring (14'') is provided with an annular nut (29) screwable into the support (1'').

2. An abrasive wheel according to claim 1, wherein openings (33, 56) are provided on the locking ring (14'', 14''') for rotating tools to engage with.

3. An abrasive wheel according to claim 1, wherein for an extension (a) of the locking flange (28, 28'', 28''') radial to the axis of symmetry (3) in relation to the difference of an exterior radius (ra) and an interior radius (ri) of the abrasive ring (2, 44)

$0.01\ (ra-ri) \leqq a \leqq 0.1\ (ra-ri)$ applies.

4. An abrasive cutting-off wheel comprising a support (1, 1', 1'', 1''') formed to be concentrical of an axis of symmetry (3) and having a hub (4, 4'', 4'''), and an abrasive tool arranged on the support (1, 1', 1'', 1'''), wherein the abrasive tool is formed as an abrasive ring (2, 2''', 44) independent of the support (1, 1', 1'', 1'''), the abrasive ring being provided with at least one reinforcement layer (43) and wherein, in the vicinity of its outer circumference, the support (1, 1', 1'', 1''') is provided with an accommodation (12, 12'', 12''') adjusting the abrasive ring (2, 2''', 44) central with the axis of symmetry (3), and with a releasable locking device for mounting the abrasive ring (2, 2''', 44) on the support (1, 1', 1'', 1'''), wherein in the area of one side (6) the support (1, 1', 1'', 1''') has, as part of the locking device, an annular flange (10, 10'', 10''') projecting from its outer circumference and against which bears the abrasive ring (2, 2''', 44), wherein the releasable locking device comprises a locking ring (14, 14', 14'', 14''') which is releasably connectable with the support (1, 1', 1") and has a locking flange (28, 28", 28'") bearing against the abrasive ring (2, 2'", 44), wherein the annular flange (10") and the locking flange (28") have the same extension (a, c) radial to the axis of symmetry (3), wherein the locking ring (14, 14' 14", 14") is arranged in alignment with the abrasive ring (2, 2'", 44) in a recess (22, 22", 22'") of the abrasive ring (2, 2'", 44), and wherein the annular flange (10", 10'" ) is arranged in alignment with the rear (45) of abrasive ring (2'", 44) in a recess (47) of the abrasive ring (44), wherein for an extension (a) of the locking flange (28, 28", 28'") radial to the axis of symmetry (3) in relation to an difference of the exterior radius (ra) and an interior radius (ri) of the abrasive ring (2, 44)

$0.01\ (ra-ri) \leqq a \leqq 0.1\ (ra-ri)$ applies.

* * * * *